US005368784A

United States Patent [19]

Annestedt, Sr.

[11] Patent Number: 5,368,784

[45] Date of Patent: Nov. 29, 1994

[54] SCOOP HUMIDIFIER

[75] Inventor: James W. Annestedt, Sr., Memphis, Tenn.

[73] Assignee: American Metal Products Co., Olive Branch, Miss.

[21] Appl. No.: 133,706

[22] Filed: Oct. 8, 1993

[51] Int. Cl.[5] ..... B01F 3/04

[52] U.S. Cl. ..... 261/105; 261/106; 261/DIG. 15

[58] Field of Search ..... 261/DIG. 15, 106, 105

[56] References Cited

U.S. PATENT DOCUMENTS

| | | | |
|---|---|---|---|
| 2,268,540 | 1/1942 | Andrews | 261/DIG. 15 |
| 2,639,905 | 5/1953 | Dow . | |
| 2,858,825 | 11/1958 | Skerritt | 261/DIG. 15 |
| 2,984,464 | 5/1961 | Herr . | |
| 3,092,096 | 6/1963 | Nett et al. | 261/DIG. 15 |
| 3,105,860 | 10/1963 | Dunn . | |
| 3,148,964 | 9/1964 | Flury . | |
| 3,149,626 | 9/1964 | Wentling et al. . | |
| 3,171,401 | 3/1965 | McDuffee | 261/DIG. 15 |
| 3,189,328 | 6/1965 | Hotchkiss . | |
| 3,193,259 | 7/1965 | Liebmann | 261/DIG. 15 |
| 3,274,992 | 9/1966 | Martin . | |
| 3,290,020 | 12/1966 | Findley . | |
| 3,294,376 | 12/1966 | Eranosian . | |
| 3,304,066 | 2/1967 | Vieceli et al. . | |
| 3,305,173 | 2/1967 | Beckman . | |
| 3,315,948 | 4/1967 | Martin . | |
| 3,337,196 | 8/1967 | McCoy et al. . | |
| 3,355,155 | 11/1967 | Heltzen et al. . | |
| 3,400,919 | 9/1968 | Schall | 261/DIG. 15 |
| 3,437,318 | 4/1969 | Abbott et al. | 261/DIG. 15 |
| 3,481,746 | 1/1970 | Swimmer et al. . | |
| 3,512,763 | 5/1970 | Winton . | |
| 3,739,767 | 6/1973 | Peters . | |
| 3,770,254 | 11/1973 | Morrow . | |
| 3,823,926 | 7/1974 | Bracich | 261/DIG. 15 |
| 3,854,468 | 12/1974 | Nozaki . | |
| 3,902,473 | 9/1975 | Yeagle . | |
| 3,929,941 | 12/1975 | Horne . | |
| 4,006,674 | 2/1977 | Culver . | |
| 4,552,059 | 11/1988 | Potter . | |
| 4,753,218 | 6/1988 | Potter . | |
| 4,977,756 | 12/1990 | Brock . | |
| 4,986,937 | 1/1991 | Sorio . | |
| 5,059,357 | 10/1991 | Wolf et al. . | |
| 5,171,486 | 12/1992 | Penno . | |

*Primary Examiner*—Tim Miles

*Attorney, Agent, or Firm*—Edgar A. Zarins; Malcolm L. Sutherland

[57] ABSTRACT

A furnace mounted humidifier for increasing the moisture content of the air flowing through the humidifier and subsequently the air flowing from the furnace. The simple construction of the scoop humidifier ensures convenient installation and operation while adding moisture to the air flow. The humidifier includes a housing adapted to be mounted to the furnace wall and inlet and outlet passageways positioned within the duct for directing air flow into and out of the housing. A moisture media within the housing retains water sprayed across it through which the air flow is directed. The configuration of the air passageways and the housing facilitate the continuous flow of air across the moisture media.

10 Claims, 3 Drawing Sheets

SCOOP HUMIDIFIER

BACKGROUND OF THE INVENTION

I. Field of the Invention

This invention relates to a humidifier for a forced-air furnace system and, in particular, to a humidifier adapted to be mounted within a duct wall for redirecting air flow from the duct across a moisture media and back into the duct.

II. Description of the Prior Art

Humidifiers have been widely used to increase the comfort of inside environments by adding moisture to air which tends to be dry because of heating and low humidity levels. Stand alone humidifiers are useful for single room applications. However, furnace mounted humidifiers add moisture to the air which is circulated throughout a home and therefore have wider application. The moisture is added to the air through evaporation from a water pool, a moisture media or through atomization of water into the air flow. Typically, the air flow is diverted through the humidifier housing from a high pressure side of the furnace and outlet to a low pressure side creating the necessary air flow for adding moisture.

In order to transfer moisture to the air flowing through the humidifier various mechanical systems are employed by prior known humidifiers. A water reservoir within the humidifier may be vibrated to atomize the water for interaction with the air flow. Still other systems employ a rotating drum which carries a water reservoir and then into the air stream to transfer moisture to the air by evaporation. Other rotating drum systems actually scoop the water from the reservoir causing evaporation as the water is spilled back into the reservoir from the top of the drum. Finally, the simplest prior known humidifying systems simply direct the forced air flow across the top of a water reservoir counting on evaporation to transfer moisture to the air stream.

SUMMARY OF THE PRESENT INVENTION

The present invention overcomes the disadvantages of the prior known humidifying systems by providing an effective yet convenient system which can be easily installed within the duct of a forced air heating system.

The humidifier of the present invention is easily installed within a duct requiring only one cut-out opening for installation. Additionally, the system includes no moving parts requiring maintenance yet freely directs air flow across a moisture media to humidify the air stream. The inlet and outlet of the humidifier are positioned side-by-side to minimize intrusion into the duct work yet create a smooth flow through the humidifier.

The humidifier includes a housing adapted to be mounted to the duct of the forced air heating system downstream of the furnace fan. Disposed within the housing is a moisture media across which water is intermittently sprayed. Excess water is collected at the bottom of the housing and drained away. Disposed within the opening to the housing and extending into the duct of the forced air system are substantially parallel inlet and outlet passageways. The inlet passageway is positioned on the upstream side of the humidifier to direct air flow from the duct into the housing for interaction with the moisture media. The outlet passageway is positioned on the downstream side for smoothly directing the humidified air back into the duct. Both passageways preferably have a curvature in the nature of scoops to smoothly direct the air flow into and out of the humidifier to maximize air flow therethrough and consequently maximize humidity levels.

Other objects, features and advantages of the invention will be apparent from the following detailed description taken in connection with the accompanying drawing.

BRIEF DESCRIPTION OF THE DRAWING

The present invention will be more fully understood by reference to the following detailed description of a preferred embodiment of the present invention when read in conjunction with the accompanying drawing, in which like reference characters refer to like parts throughout the view and in which.

DETAILED DESCRIPTION OF A PREFERRED EMBODIMENT OF THE PRESENT INVENTION

Figure 1:
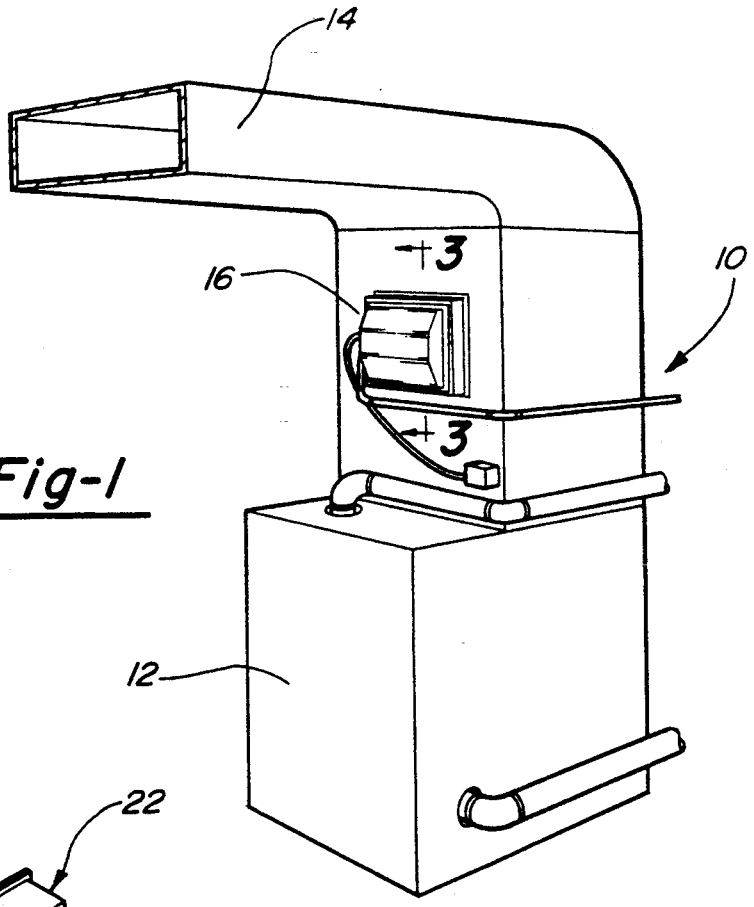
FIG. 1 is a perspective view of a forced air heating system having the scoop humidifier of the present invention mounted thereto.

Referring first to FIG. 1, there is shown a portion of a forced air heating system 10 incorporating a furnace 12 and ducts 14 to deliver the air to various portions of the home or building. The furnace 12 typically includes some type of heating system and a fan for blowing the heated air throughout the system 10. The humidifier 16 of the present invention is preferably mounted to a heat duct 14 of the system 10 downstream of the furnace 12 to add moisture or humidity to the air being blown through the system 10. The humidifier 16 is mounted within a wall 18 of the duct 14 in communication with the duct interior.

Figure 2:
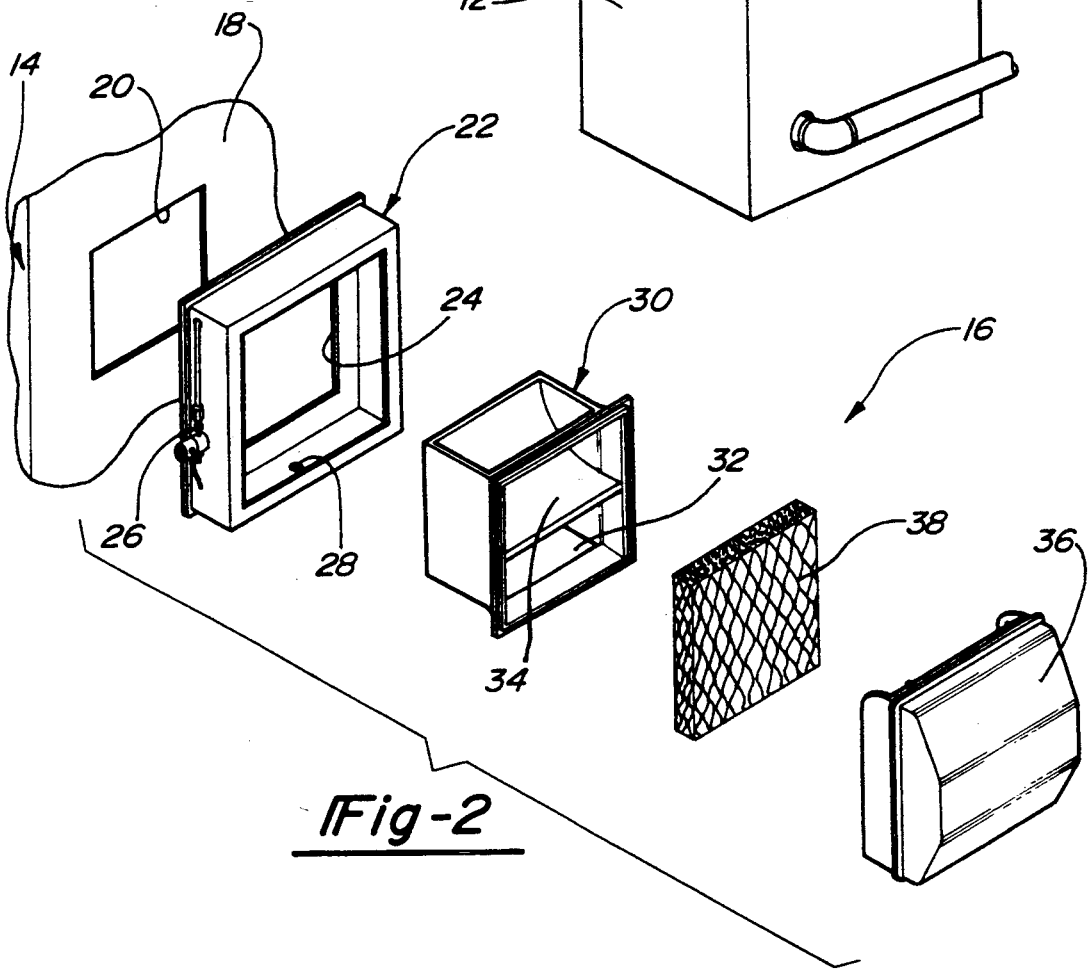
FIG. 2 is an exploded view of the scoop humidifier.
Figure 3:
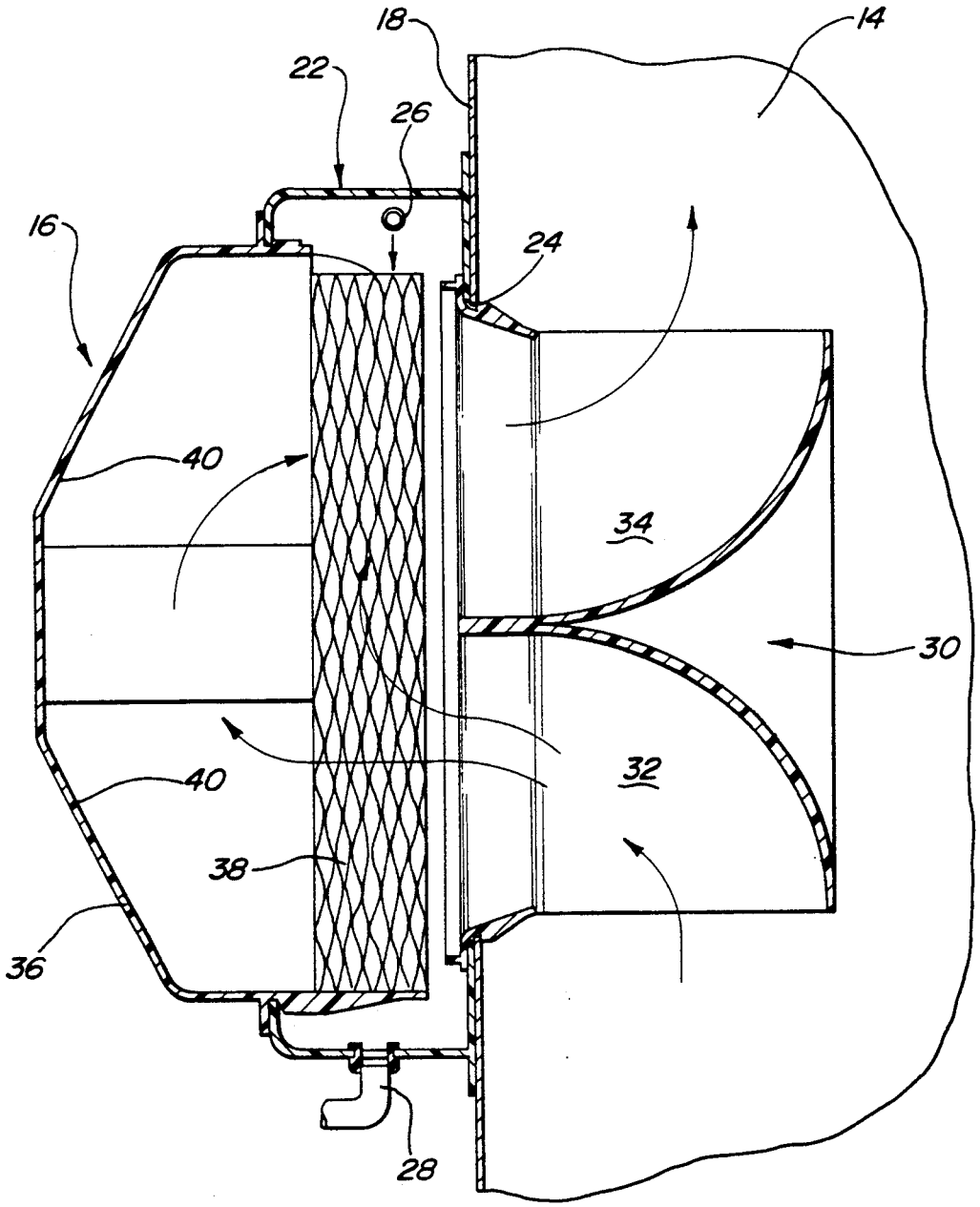
FIG. 3 is a cross-sectional view of the scoop humidifier mounted within an air duct taken along lines 3—3 of FIG. 1.

Referring now to FIGS. 2 and 3, the humidifier 16 of the present invention provides convenient installation into the forced air system 10. To accommodate the humidifier 16 an opening 20 is cut within the duct wall 18. A housing frame 22 is mounted to the exterior of the duct 14 using conventional sheet metal fasteners. The frame 22 includes an interior opening 24 designed to align with the opening 20 of the duct wall 18. In a preferred embodiment, a water delivery system 26 is mounted within the frame 22 to deliver the water for humidifying as will be subsequently described. A drain 28 in the bottom of the frame 22 allows the removal of excess water.

Matingly received within the opening 24 of the frame 22 and therefore the duct opening 20 is the passageway housing 30 forming an inlet passageway 32 and an outlet passageway 34. The passageway housing 30 is specifically configured to be detachably received within the frame 22 and also preferably has a square configuration to facilitate orientation in any direction, i.e. up-down or side-to-side, to accommodate different furnace configurations. The passageways 32,34 are curved to smoothly direct air flow into and out of the humidifier 16. In a preferred embodiment, the passageway housing 20 telescopically snaps within the frame 22.

A housing cover 36 is attached to the frame 22 to enclose the moisture media 38 and ensure circulation of the air through the humidifier 16. In a preferred embodiment, the cover 36 detachably snaps onto the frame 22 but is pivotable within the frame 22 to allow access to the interior of the housing such as for replacement of the moisture media 38. With the cover 36 closed, the moisture media 38 is positioned beneath the water supply tube 26 and perpendicular to the flow of air both into and out of the humidifier 16. The cover 36 is configured to foster the smooth flow of air through the humidifier 16. Angled sections 40 of the cover 36 direct air flow from the inlet 32 back towards the outlet 34.

The configuration of the humidifier 16 and the mating relationship of the various components facilitates installation and maintenance of the humidifier 16. Once the cut-out 20 is formed in the duct 14, the frame 22 is secured to the duct wall 18 aligning the opening 24 with the cut-out 20. The passageway housing 30 is then inserted through the opening 24 with the inlet passageway 32 oriented towards the blower fan of the furnace 12 and the outlet 34 oriented downstream thereof. The passageway housing 30 may simply be snapped into position using a tongue and groove structure or may be more fixedly secured using auxiliary fasteners. The cover 36 is then attached to the frame 22 such that the cover 36 can be pivoted open within the frame 22. Finally, the moisture media 38 is positioned within the humidifier 16. Once a water supply is connected to the water delivery system 26 a continuous supply of water will be applied to the moisture media 38 during operation of the humidifier. Sensors and valves may form a part of the delivery system 28 to spray water across the moisture media only under certain operating conditions.

Figure 4:
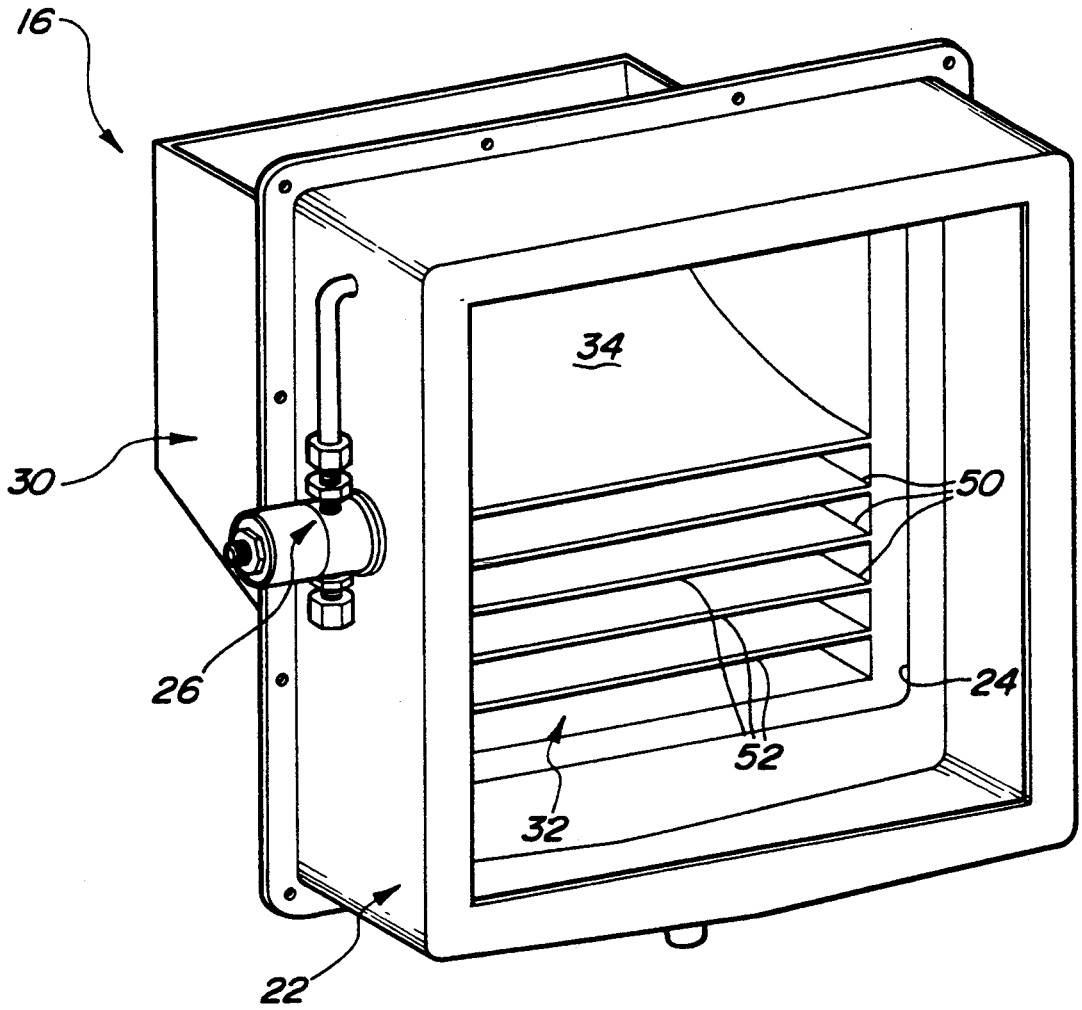
FIG. 4 is a perspective view of an alternative embodiment of the scoop humidifier with a divided inlet passageway.

FIG. 4 shows an alternative embodiment of the humidifier 16 incorporating an alternative passageway housing 30. The housing 30 includes an outlet passageway 34 and an inlet passageway 32 which is divided into a plurality of parallel passages 50. The passages 50 have a curved configuration crated by semicircular walls 52 disposed within the inlet passageway 32. The parallel passages 50 provide a wider dispersion of air across the moisture media 38 particularly the inner edge of the inlet passageway 32.

Operation of the humidifier 16 provides a simple and economical means of adding moisture to the air of a forced air heating system. As the blower fan forces air through the duct 14, a portion of the air flow will be diverted by the inlet passageway 32 extending into the duct 14. The air will be directed through and across the moisture media 38 and out the outlet passageway 334 back into the duct 14. As a result, the moist air is delivered throughout the heating system of the house.

The foregoing detailed description has been given for clearness of understanding only and no unnecessary limitations should be understood therefrom as some modifications will be obvious to those skilled in the art without departing from the scope and spirit of the appended claims.

What is claimed is:

1. An air humidification system for a forced air circulation system having an air duct, said humidification system comprising:

a main housing mountable to the air duct, said main housing including an opening adapted to be aligned with a cut-out in the air duct to provide fluid communication between said main housing and the air circulation system;

a moisture media disposed within said housing across said opening such that air flow through said opening is directed across said moisture media;

means for maintaining a predetermined moisture level in said moisture media; and a passageway housing having an inlet passageway for directing air flow from the duct through said opening into said main housing and an outlet passageway for direction air flow from said main housing into the duct, said inlet and outlet passageways having coplanar interior ports, curved semi-circular configurations, and parallel exterior ports, said passageway housing mounted within said opening of said main housing and extending into the air duct through the duct cut-out such that said exterior ports of said passageway housing are in the stream of fluid flow through the duct for diverting air flow from the duct through said inlet passageway across said moisture media within said main housing and return humidified air through said outlet passageway to the air duct of the circulation system.

2. The humidification system as defined in claim 1 wherein said main housing comprises a frame attachable to the duct and a housing cover detachably mounted to said frame.

3. The humidification system as defined in claim 1 wherein said housing cover is pivotably attached to said frame for selective access to the interior of said main housing.

4. The humidification system as defined in claim 1 wherein said inlet passageway includes at least one divider wall forming a plurality of parallel passages within said inlet passageway.

5. The humidification system as defined in claim 1 wherein said moisture media is positioned across said interior ports of said inlet and outlet passageways and perpendicular to the air flow into and out of said passageway housing such that air flows through said moisture media.

6. An air humidification system for forced air circulation system having an air duct, said humidifier system comprising:

a main housing including a frame attachable to the duct and having an opening adapted to be aligned with a cut-out in the duct and a housing cover mounted to said frame, said opening and duct cut-out providing fluid communication between said main housing and the air circulation system;

a passageway housing mounted within said opening of said frame and extending into the air duct, said passageway housing including an inlet passageway for diverting air flow from the duct into said main housing and an outlet passageway for diverting air flow from said main housing into the duct, said inlet and outlet passageways having coplanar interior ports, curved, diverging semi-circular configurations, and parallel exterior ports perpendicular to said interior ports;

a moisture media disposed within said main housing across said interior ports of said inlet and outlet passageways wherein air flow from the duct is directed through said inlet passageway perpendicularly across said moisture media and air flow from said main housing is directed perpendicularly across said moisture media through said outlet passageway to return humidified air to the air duct of the circulation system; and means for maintaining a predetermined moisture level in said moisture media.

7. The humidification system as defined in claim 6 wherein said housing cover is pivotably attached to said frame for selective access to the interior of said main housing.

8. The humidification system as defined in claim 6 wherein said inlet passageway includes at least one divider wall forming a plurality of curved parallel passages within said inlet passageway.

9. The humidification system as defined in claim 6 wherein said housing cover includes outer diverter walls for direction airflow from said inlet passageway back through said moisture media into said outlet passageway.

10. An air humidification system for a forced air circulation system having an air duct, said humidification system comprising:

a main housing including a frame attachable to the duct and having an opening adapted to be aligned with a cut-out in the duct and a housing cover mounted to said frame, said opening and duct cut-out providing fluid communication between said main housing and the air circulation system;

a passageway housing mounted within said opening of said frame and extending into the air duct, said passageway housing having a pair of air flow passageways including an inlet passageway for diverting air flow from the duct into said main housing and an outlet passageway for diverting air flow from said main housing into the duct, said inlet and outlet passageways having coplanar interior ports, diverging semi-circular configurations, and parallel exterior ports;

a moisture media disposed within said main housing said interior ports of said inlet and outlet passageways wherein air flow from the duct is perpendicularly diverted from said exterior prot to said interior port through said inlet passageway across said moisture media and air flow from said main housing is directed across said moisture media and perpendicularly diverted through said outlet passageway from said interior port through said exterior port to return humidified air to the air duct of the circulation system; and means for maintaining a predetermined moisture level in said moisture media.

* * * * *